US011541448B1

(12) United States Patent
Simos

(10) Patent No.: US 11,541,448 B1
(45) Date of Patent: Jan. 3, 2023

(54) WIRE SHAPING TOOL AND METHODS OF CREATING SHAPED ITEMS

(71) Applicant: Timotheos G. Simos, Fort Pierce, FL (US)

(72) Inventor: Timotheos G. Simos, Fort Pierce, FL (US)

( * ) Notice: Subject to any disclaimer, the term of this patent is extended or adjusted under 35 U.S.C. 154(b) by 0 days.

(21) Appl. No.: 17/305,918

(22) Filed: Jul. 16, 2021

(51) Int. Cl.
*B21F 33/00* (2006.01)
*B21F 27/00* (2006.01)
*A44C 27/00* (2006.01)

(52) U.S. Cl.
CPC ..... *B21F 33/007* (2013.01); *B21F 27/00* (2013.01); *A44C 27/00* (2013.01)

(58) Field of Classification Search
CPC .. B21F 1/00; B21F 1/002; B21F 15/02; B21F 27/00; B21F 27/005; B21F 33/00; B21F 33/007; B21D 7/06; B21D 7/063; B21D 5/01; B21D 13/02; H01R 43/0335; B25B 7/02; B25B 27/146
See application file for complete search history.

(56) References Cited

U.S. PATENT DOCUMENTS 6,017 A * 1/1849 McCulley
391,227 A * 10/1888 Buckman
597,649 A * 1/1898 Lindas
6,659,141 B2 * 12/2003 Lawrence ..... B21D 7/063 140/106
2018/0009095 A1 * 1/2018 Liao ..... B25B 7/02

* cited by examiner

*Primary Examiner* — Teresa M Ekiert
(74) *Attorney, Agent, or Firm* — Nolan IP Law; Jason M. Nolan

(57) ABSTRACT

A wire shaping tool and method of using the tool to reshape wire, including the discrete sections of wire in a wire mesh panel, is provided. The tool includes a pair of levers joined at a fulcrum positioned closer to one end of the levers, a pair of jaws on one side of the fulcrum, and a pair of handles on the other side. The first jaw can include an elongate body with a concave surface having a pair of opposing lateral edges. The second jaw can include a complementary convex surface configured to converge toward contacting the concave surface of the first jaw. The concave and complementary convex surfaces can transform the shape of a wire positioned between the jaws when they are actuated. The second jaw can include a third shaping component that allows for the simultaneous reshaping of two adjacent wire sections in a wire mesh panel.

20 Claims, 14 Drawing Sheets

WIRE SHAPING TOOL AND METHODS OF CREATING SHAPED ITEMS

FIELD

The present disclosure relates to a tool for shaping metal wire, including multiple sections of wire in a wire mesh, and a method of creating a shaped item using the tool.

BACKGROUND

Existing hand tools for bending and reshaping metal strips and wires, including ring bending pliers (FIG. 1), jewelry pliers, wrap and tap pliers, etc., generally comprise a pair of handles and a pair of jaws, the jaws having opposing surfaces that can be used to reshape a metal strip or wire into a ring, coil, or semicircle. But such tools are limited to shaping a single piece of metal, and repetitive use of the tools to reshape multiple pieces of metal is cumbersome and painful to a user actuating the handles. Furthermore, the tools configured to reshape a single strip of metal into a ring are not configured to reshape one or more sections of metal wire within a wire mesh. For at least these reasons, improved metal shaping tools are needed.

SUMMARY

In various embodiments, a wire shaping tool is provided. The tool can comprise: a pair of levers joined at a fulcrum positioned closer to one end of the levers, the pair of levers comprising a pair of jaws on a first side of the fulcrum and a pair of handles on a second side of the fulcrum, wherein the second side has a second length that is longer than a first length of the first side, and wherein the pair of jaws are movable about the fulcrum between an open position defined by a spaced distance between the first and second jaws, and a closed position defined by a converging of the first and second jaws; wherein the pair of jaws comprises a first jaw and a second jaw; the first jaw comprising an elongate body comprising a concave surface having a pair of opposing lateral edges, the elongate body comprising a front portion demarcated from a rear portion by a step on each of the opposing lateral edges; and the second jaw comprising a complementary convex surface configured to contact the concave surface of the first jaw; and wherein the concave and complementary convex surfaces are configured to transform a first shape of a first object positioned in the spaced distance into a second shape as the pair of jaws is actuated to approach the closed position with the object therebetween.

In some embodiments, the wire shaping tool comprises a pair of caps covering the opposing lateral edges of the front portion of the first jaw. In some embodiments, the front and rear portions of the elongate body of the first jaw have different heights, the different heights being demarcated by the step on each of the opposing lateral edges. In some embodiments, the front portion of the elongate body of the first jaw is insertable through an aperture of a wire mesh panel, and the rear portion is not insertable through the aperture due to the step on each of the opposing lateral edges of the elongate body. In some embodiments, the second jaw comprises an elongate body comprising a front semi-cylindrical shaped portion demarcated from a rear cylindrical portion.

In some embodiments, the wire shaping tool comprises a third shaping component projecting from the rear cylindrical portion of the second jaw, the third shaping component comprising a convex surface for reshaping a second object positioned in a second spaced distance between the second jaw and the third shaping component, wherein the convex surface of the third shaping component faces the second jaw. In some embodiments, the second jaw is insertable through a first aperture of the wire mesh, and the third shaping component is insertable through a second aperture of the wire mesh, wherein the first and second apertures are adjacent to one another. In some embodiments, the front semi-cylindrical shaped portion of the second jaw is configured to reshape a first wire section of the wire mesh and the third shaping component is configured to reshape a second wire section of the wire mesh, wherein the first and second wire sections are parallel and sequentially adjacent to one another.

In some embodiments, the wire shaping tool is configured for a mechanical device. In some embodiments, the mechanical device is a pneumatic device.

In additional embodiments, a wire shaping tool is provided. The tool can comprise: a pair of levers joined at a fulcrum positioned closer to one end of the levers, the pair of levers comprising a pair of jaws on a first side of the fulcrum and a pair of handles on a second side of the fulcrum, wherein the second side has a second length that is longer than a first length of the first side, and wherein the pair of jaws are movable about the fulcrum between an open position defined by a spaced distance between the first and second jaws, and a closed position defined by a converging of the first and second jaws; wherein the pair of jaws comprises a first jaw and a second jaw; the first jaw comprising an elongate body comprising a concave surface having a pair of opposing lateral edges, the elongate body comprising a front portion demarcated from a rear portion by a step on each of the opposing lateral edges; and the second jaw comprising a complementary convex surface configured to contact the concave surface of the first jaw; wherein the concave and complementary convex surfaces are configured to transform a first shape of a first object positioned in the spaced distance into a second shape as the pair of jaws is actuated to approach the closed position with the object therebetween; and wherein the second jaw further comprises a third shaping component projecting from a rear cylindrical portion of the second jaw, the third shaping component comprising a convex surface for reshaping a second object positioned between the second jaw and the third shaping component, wherein the convex surface of the third shaping component faces the second jaw.

In some additional embodiments, the tool comprises a pair of caps covering the opposing lateral edges of the front portion of the first jaw. In the additional embodiments, the front and rear portions of the elongate body of the first jaw have different heights, the different heights being demarcated by the step on each of the opposing lateral edges. In some additional embodiments, the front portion of the elongate body of the first jaw is insertable through an aperture of a wire mesh panel, and the rear portion is not insertable through the aperture due to the step on each of the opposing lateral edges of the elongate body. In some additional embodiments, the second jaw comprises an elongate body comprising a front semi-cylindrical shaped portion demarcated from the rear cylindrical portion. In some additional embodiments, the second jaw is insertable through a first aperture of the wire mesh, and the third shaping component is insertable through a second aperture of the wire mesh, wherein the first and second apertures are adjacent to one another. In some additional embodiments, the front semi-cylindrical shaped portion of the second jaw is configured to reshape a first wire section of the wire mesh and the third shaping component is configured to reshape a second wire section of the wire mesh, wherein the first and second wire sections are parallel and sequentially adjacent to one another. In some additional embodiments, the wire shaping tool is configured for a mechanical device. In some embodiments, the mechanical device is a pneumatic device.

In various embodiments, a method of reshaping certain wire sections of a mesh wire panel is provided. The method can comprise: providing the panel of wire mesh comprising a plurality of longitudinal wires positioned parallel to one another about a longitudinal axis and a plurality of transverse wires positioned parallel to one another about a transverse axis, the plurality of longitudinal and transverse wires being affixed together and integrated into the panel of wire mesh to provide a plurality of apertures, each aperture defined by a pair of sequential, spaced apart longitudinal wires and a pair of sequential, spaced apart transverse wires; providing a tool comprising a pair of levers joined at a fulcrum positioned closer to one end of the levers, the pair of levers comprising a pair of jaws on a first side of the fulcrum and a pair of handles on a second side of the fulcrum, wherein the second side has a second length that is longer than a first length of the first side, and wherein the pair of jaws are movable about the fulcrum between an open position defined by a spaced distance between the first and second jaws, and a closed position defined by a converging of the first and second jaws; wherein the pair of jaws comprises a first jaw and a second jaw; the first jaw comprising an elongate body comprising a concave surface having a pair of opposing lateral edges, the elongate body comprising a front portion demarcated from a rear portion by a step on each of the opposing lateral edges; and the second jaw comprising a complementary convex surface configured to contact the concave surface of the first jaw; and wherein the concave and complementary convex surfaces are configured to transform a first shape of a first mesh wire panel component positioned in the spaced distance into a second shape as the pair of jaws is actuated to approach the closed position with the first mesh wire panel component therebetween; inserting a section of a first longitudinal wire of the mesh wire panel having the first shape into the spaced distance between the first and second jaws; actuating the pair of handles to move the pair of jaws from the open position toward the closed position until interrupted by contacting the section of the first longitudinal wire; and further actuating the pair of handles to transform the section of the first longitudinal wire into the second shape.

In some embodiments of the method, the tool further comprises a pair of caps covering the opposing lateral edges of the front portion of the first jaw.

In some embodiments of the method, the second jaw comprises an elongate body comprising a front semi-cylindrical shaped portion demarcated from a rear cylindrical portion.

In some embodiments of the method, the second jaw further comprises a third shaping component projecting from the rear cylindrical portion of the second jaw, the third shaping component comprising a convex surface for reshaping a second mesh wire panel component positioned in a second spaced distance between the second jaw and the third shaping component, wherein the convex surface of the third shaping component faces the second jaw; and inserting a section of a second longitudinal wire of the mesh wire panel into the second spaced distance, wherein the actuating the pair of handles step causes the third shaping component to contact and reshape the section of the second longitudinal wire.

In some embodiments of the method, the first shape is substantially linear and the second shape is curved. In some embodiments of the method, the actuating of the first and/or second jaws and the actuating of the second jaw and/or the third shaping component occur simultaneously. In some embodiments of the method, actuating the tool using the mechanical device. In some embodiments, the mechanical device is a pneumatic device.

The foregoing general summary is intended to provide an overview or framework for understanding the nature and character of the embodiments disclosed herein. This summary is not intended to identify essential inventive concepts of the claimed subject matter or limit the scope of the claimed subject matter. Additional features and advantages of the embodiments disclosed herein will be set forth in the detailed description that follows, and in part will be clear to those skilled in the art from that description or recognized by practicing the embodiments described herein, including the detailed description that follows, the claims, and the appended drawings.

BRIEF DESCRIPTION OF THE DRAWINGS

A complete understanding of the present embodiments and the advantages and features thereof will be more readily understood by reference to the following detailed description, appended claims, and accompanying drawings, wherein:

Figure 1:
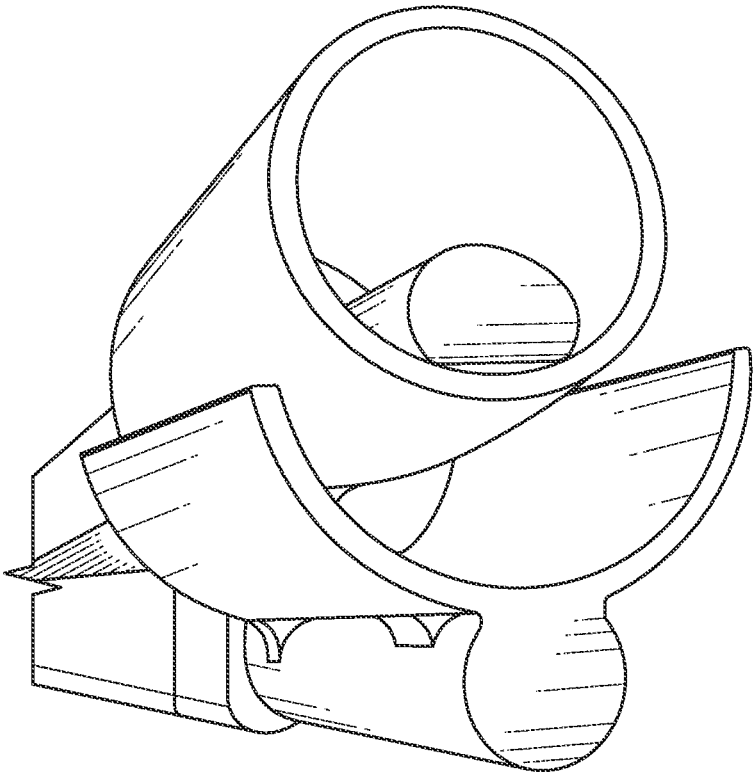
FIG. 1 (Prior Art)
FIG. 1 (Prior Art) shows a perspective view of the jaws of an existing wire shaping tool.

The drawings are not necessarily to scale, and certain features and certain views of the drawings may be shown exaggerated in scale or in schematic in the interest of clarity and conciseness.

DETAILED DESCRIPTION

Reference will now be made in detail to the exemplary embodiment(s), examples of which is/are illustrated in the accompanying drawings. Whenever possible, the same reference numerals will be used throughout the drawings to refer to the same or like parts.

Before describing the exemplary embodiments, it is noted some embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the various embodiments described herein are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

In various embodiments, as shown in FIGS. 2-18, a wire shaping tool and a method of using the tool to shape mesh wire is provided. In some embodiments, the wire shaping tool comprises a pair of levers joined at a fulcrum positioned closer to one end of the levers. In such embodiments, the interruption in the levers by the fulcrum creates a pair of jaws on the shorter side of the fulcrum and a pair of handles on the longer side of the fulcrum. The shorter side has a length measured from the fulcrum to the end that is less than the length of the longer side, as measured from the fulcrum to the opposite end. During use, the fulcrum allows for the transition between an open position in which the jaws and handles are spaced apart from one another, and a closed position in which the jaws and handles converge toward one another. In some embodiments, the jaws contact one another in the closed position.

Figure 15A:
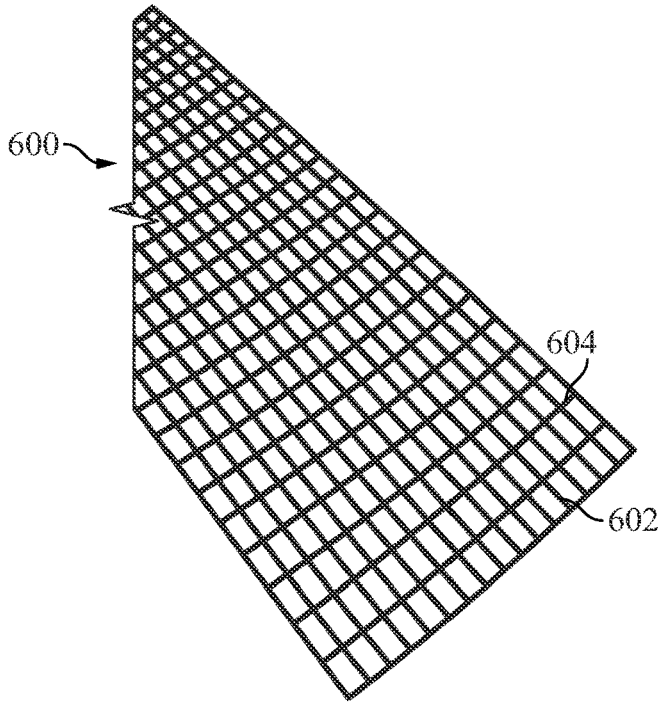
FIG. 15A shows a wire mesh panel used in embodiments described herein.

As described herein, the wire shaping tool comprises a pair of jaws configured to reshape a metal wire, including, for example, a section of wire in a wire mesh. During the manufacturing process for preparing wire mesh, a plurality of long line wires is combined with a plurality of shorter cross wires to form a wire mesh that can span dozens or hundreds of feet in length, and when the desired length of wire mesh has been produced (e.g., 100 feet), the plurality of line wires are cut, and the obtained span of wire mesh is rolled up for shipping. The long line wires that run the length of the wire mesh roll are called warp wires (W), and the shorter cross wires are called shute wires (S). Prior to use by a third party or user, the roll of wire mesh can be unrolled and cut to a desired length (e.g., 3 feet) to obtain a wire mesh panel. Depending on the dimensions of the wire mesh and the position where the user cuts the panel from the wire mesh roll, the obtained two-dimensional shape of the wire mesh panel is a rectangle having shorter warp wires than shute wires, a square having warp and shute wires of equal length, or a rectangle having longer warp wires than shute wires. In FIG. 15A, for example, the wire mesh panel 600 has a rectangular two-dimensional shape in which the plurality of warp wires (e.g., 604) are shorter than the plurality of shute wires (e.g., 602).

The individual wires of a wire mesh or wire mesh panel can have any suitable three-dimensional shape, including, for example, a substantially circular cross-sectional shape, a substantially flat shape (e.g., metal ribbon), or any other suitable cross-sectional shape. In the context of wire mesh formed with wire having a substantially circular cross-sectional shape, the term "gauge" refers to the thickness of the individual wires in a wire mesh. The gauge can be any suitable size, including a gauge ranging from 8-gauge to 16-gauge, e.g., 10.5-gauge, 12-gauge, 12.5-gauge, 14-gauge, 16-gauge, etc.

During manufacturing, the plurality of warp and shute wires are affixed together to create a plurality of apertures (A) in the wire mesh, as shown in FIGS. 10A-18. In some embodiments, the wire mesh is galvanized (e.g., dipped in a galvanization bath after the warp and shute wires are affixed together). In some embodiments, the wire mesh is coated (e.g., with a PVC coating after the warp and shute wires are affixed together). In some embodiments, the wire mesh is galvanized and coated (e.g., after the warp and shute wires are affixed together).

Figure 12:
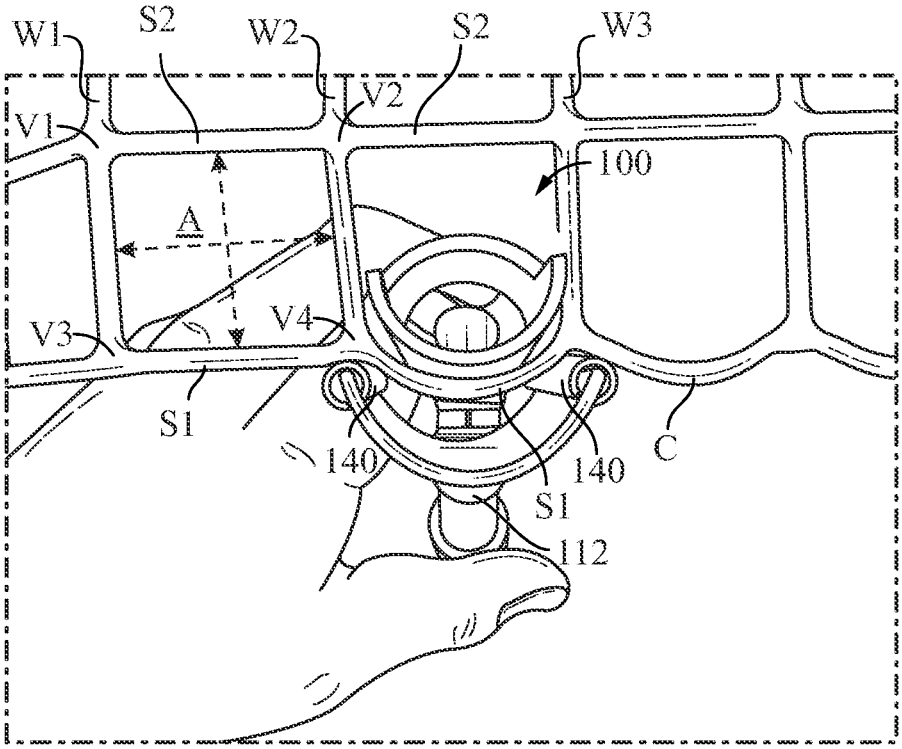
FIG. 12 illustrates the use of the wire shaping tool in FIG. 3 from a front perspective view, according to embodiments described herein.

In the embodiment shown in FIG. 12, one aperture of the plurality of apertures is labeled aperture A. The aperture A has a rectangular shape with four vertices (V1, V2, V3, V4) defined by a pair of parallel, spaced apart warp wires W1, W2 and a pair of parallel, spaced apart shute wires S1, S2. In such embodiments, the warp and shute wires contact and affix to one another at the vertices (V). In some embodiments, the aperture A has a square or rectangular two-dimensional shape. In such embodiments, each section of wire defining an edge of the aperture is substantially linear. The apertures of the wire mesh panel may be any suitable size (length×width), wherein the length is defined by the side of the aperture demarcated by the warp wires, and the width is defined by the side of the aperture demarcated by the shute wires. In some embodiments, the aperture is, for example, 0.5"×0.5"; 0.5"×1"; 1"×1"; 1.5"×1"; 1"×1.5"; 1.5"×1.5"; etc. Two-dimensional wire mesh aperture shapes other than rectangular are contemplated, including, for example, hexagonal or triagonal wire mesh.

In some embodiments, as shown in FIGS. 2-8, the wire shaping tool 100 comprises a first lever, a second lever, and a fulcrum 104. In such embodiments, the first lever comprises the first jaw 110 on the functional side of the fulcrum and the first handle 108 on the opposing side of the fulcrum; and the second lever comprises the second jaw 120 on the functional side of the fulcrum and a second handle 106 on the opposing side of the fulcrum.

Figure 2:
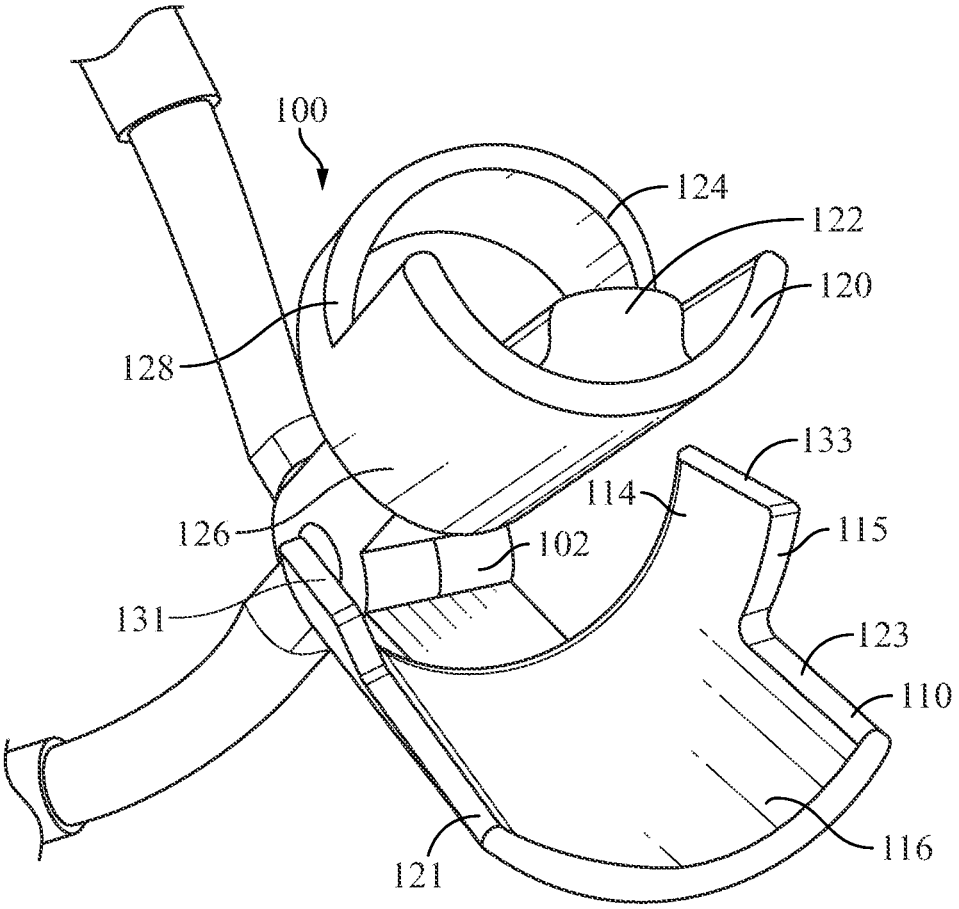
FIG. 2 shows an oblique front view of a wire shaping tool in the open position, according to embodiments described herein.

In some embodiments, the wire shaping tool 100 comprises a first jaw 110 and a second jaw 120. In some embodiments, the first jaw 110 comprises an elongate body having, for example, a hemicylindrical (half a cylinder cut lengthwise) or semicylindrical (partial cylindrical but not necessarily half; thus, semicylindrical is inclusive of hemicylindrical) shape. In such embodiments, the first jaw 110 comprises a curved or U-shaped cross-sectional shape. In such embodiments, the elongate body comprises a pair of lateral edges 121, 123, as shown in FIG. 2. In some embodiments, the elongate body is tapered such the pair of lateral edges on one end of the body are closer together than the pair of lateral edges on the opposite end of the body. For example, instead of a semicylindrical shape, the body can have a modified semicylindrical shape that accounts for the tapered lateral edges extending longitudinally from the front of the body toward the fulcrum. In some embodiments, the elongate body comprises a front portion 116 that is demarcated from a rear portion 114 by a step 115 traversing each of the lateral edges 121, 123. In such embodiments, the step 115 functions as a backstop ("stop") that limits how far a piece of wire D can be inserted into the space between the first and second jaws 110, 120 during use. In some embodiments, the step 115 is oriented perpendicular to the lateral edges 121, 123, 131, 133 on each of the front and rear portions 116, 114. In some embodiments, the step 115 is oriented at an acute, forward projecting angle (i.e., the angle formed by the step 115 and the lateral edges 121, 123 is less than 90 degrees). In such embodiments, the acute angle is sufficient to stop the insertion of an object past the front portion 116 and also prevent the object from easily sliding toward the end of the jaw and out of the device.

Figure 4A:
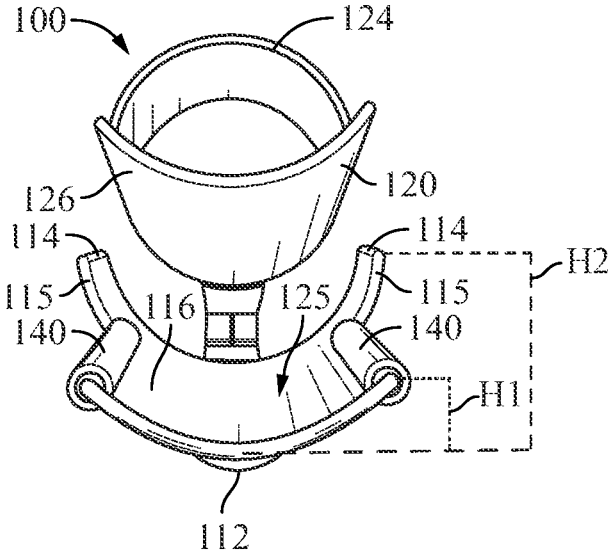
FIG. 4A shows a front view of a wire shaping tool in the open position, according to embodiments described herein.

In some embodiments, the first jaw 110 comprises a semicylindrical or modified semicylindrical elongate body having a step 115 dividing the body into front and rear portions 116, 114 such that the front and rear portions have different heights. As shown in FIG. 4A, for example, the front portion 116 has a height H1 and the rear portion 114 has a height 112. In some embodiments, due to the difference in heights, the front portion 116 may be insertable through an aperture A of a wire mesh panel, whereas the rear portion 114 may not be insertable through the aperture A depending on the relative size of the aperture A. In the embodiments in which the rear portion 114 cannot be inserted through the aperture A, the rear portion 114 functions as a stop that prevents the wire from being inserted further toward the fulcrum of the tool 100.

Figure 3:
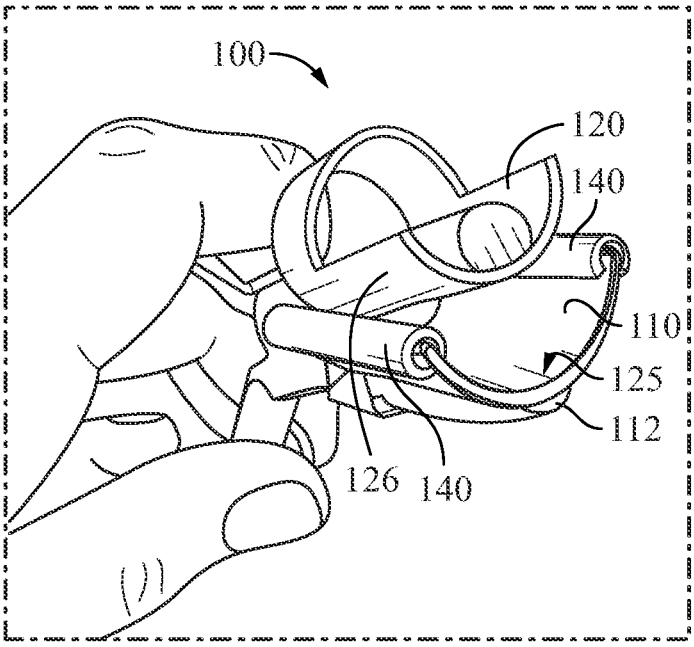
FIG. 3 shows an oblique front view of a wire shaping tool approaching the closed position, according to embodiments described herein.
Figure 4B:
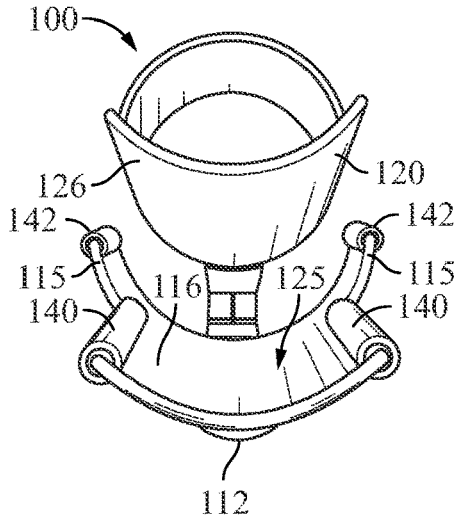
FIG. 4B shows a front view of a wire shaping tool in the open position, according to embodiments described herein.

In some embodiments, as shown in FIGS. 3, 4A, and 4B, the first jaw 110 comprises an upper surface 125 facing the second jaw 120. In some embodiments, the surface 125 comprises a predetermined shape that can be adopted by the wire D during use. In some embodiments, for example, the surface 125 is concave. In such embodiments, the resulting shape of a wire subjected to reshaping by the tool 100 is curved because it adopts the shape of the concave surface 125 the wire is pressed against. Other shapes for the surface 125 are contemplated. In some embodiments, for example, alternative shapes for the surface 125 that can be utilized to form a shape in the wire include, e.g., triangle, squared edges, zigzag, wave, etc.

Figure 5:
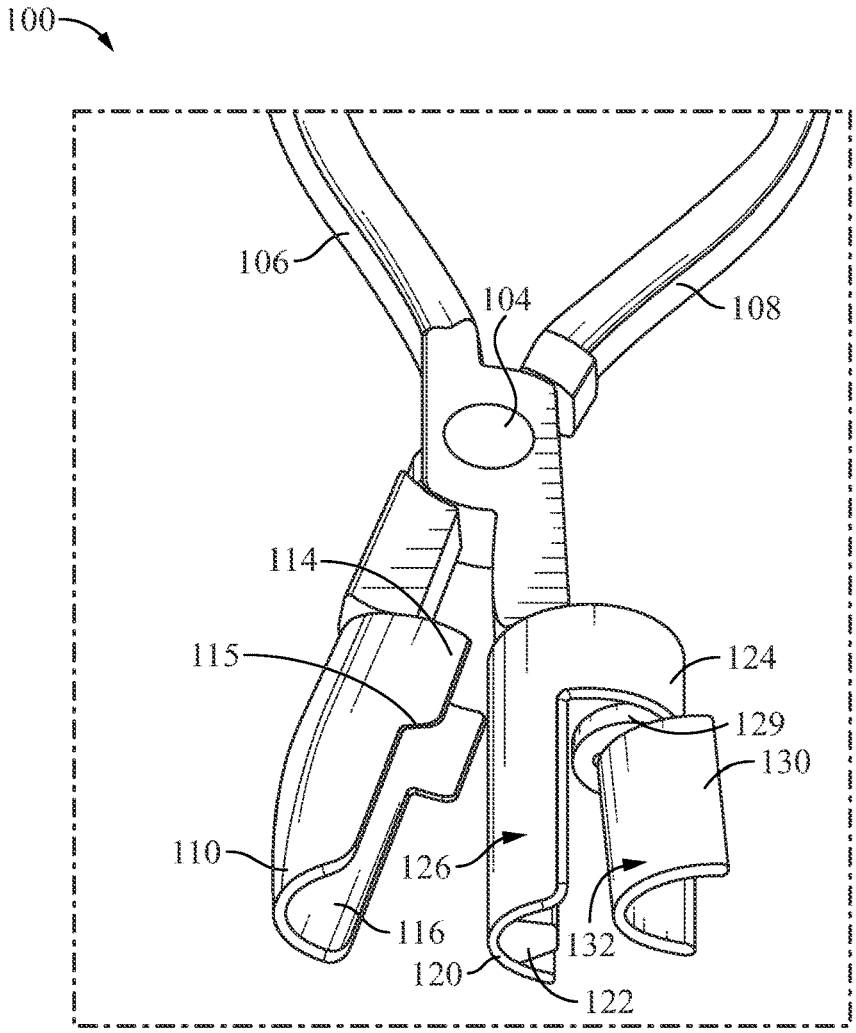
FIG. 5 shows an oblique side view of a wire shaping tool in the open position, according to embodiments described herein.
Figure 6A:
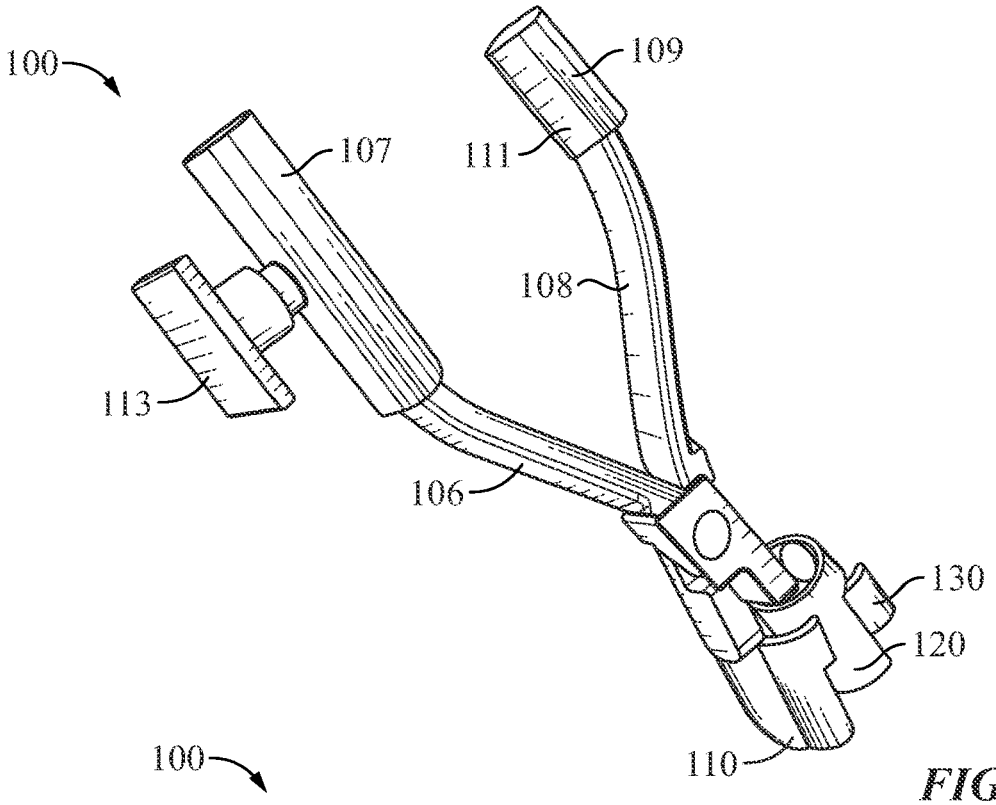
FIG. 6A shows a rear perspective side view of the wire shaping tool in FIG. 5, according to embodiments described herein.
Figure 6B:
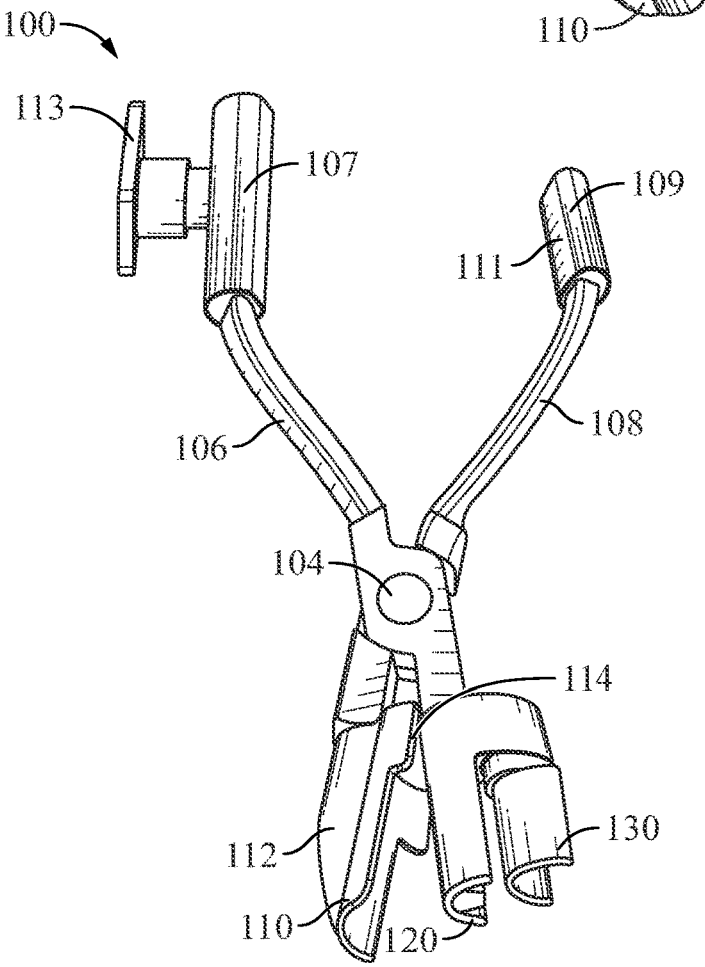
FIG. 6B shows a front perspective side view of the wire shaping tool in FIG. 5, according to embodiments described herein.

In some embodiments, the first jaw 110 comprises a support 112 from which the elongate body extends, as shown in FIGS. 3, 4A, and 4B. In such embodiments, the support 112 is a component of the first lever. In some embodiments, the support 112 is absent and the elongate body of the first jaw 110 is an integrated component of the first lever, as shown in FIG. 5.

In some embodiments, the first jaw 110 comprises a pair of caps 140 that cover the opposing lateral edges 121, 131 and 123, 133 (see FIG. 2), or select lateral edges thereof (e.g., 121 and 123). In some embodiments, the caps 140 cover the lateral edges 121, 123 of the first jaw, as shown in FIGS. 3, 4A, and 12. In some embodiments, the caps 140 cover the lateral edges 121, 123 of only the front portion 116 of the first jaw 110, as shown in FIG. 4A. In some embodiments, the caps 140 cover the lateral edges 121, 131 and 123, 133 of the first jaw 110, as shown in FIG. 4B.

Figure 7:
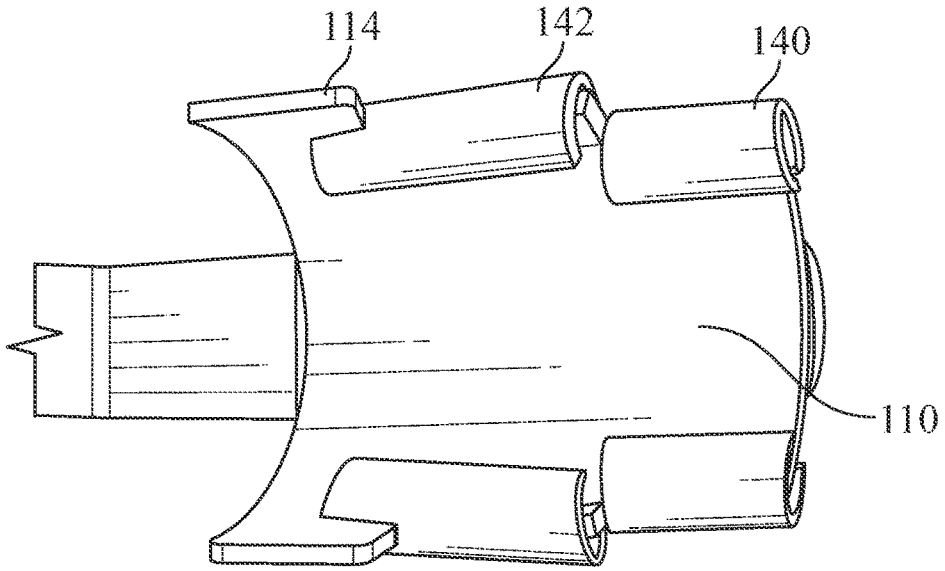
FIG. 7 shows an oblique top view of the bottom jaw of a wire shaping tool, according to embodiments described herein.
Figure 8:
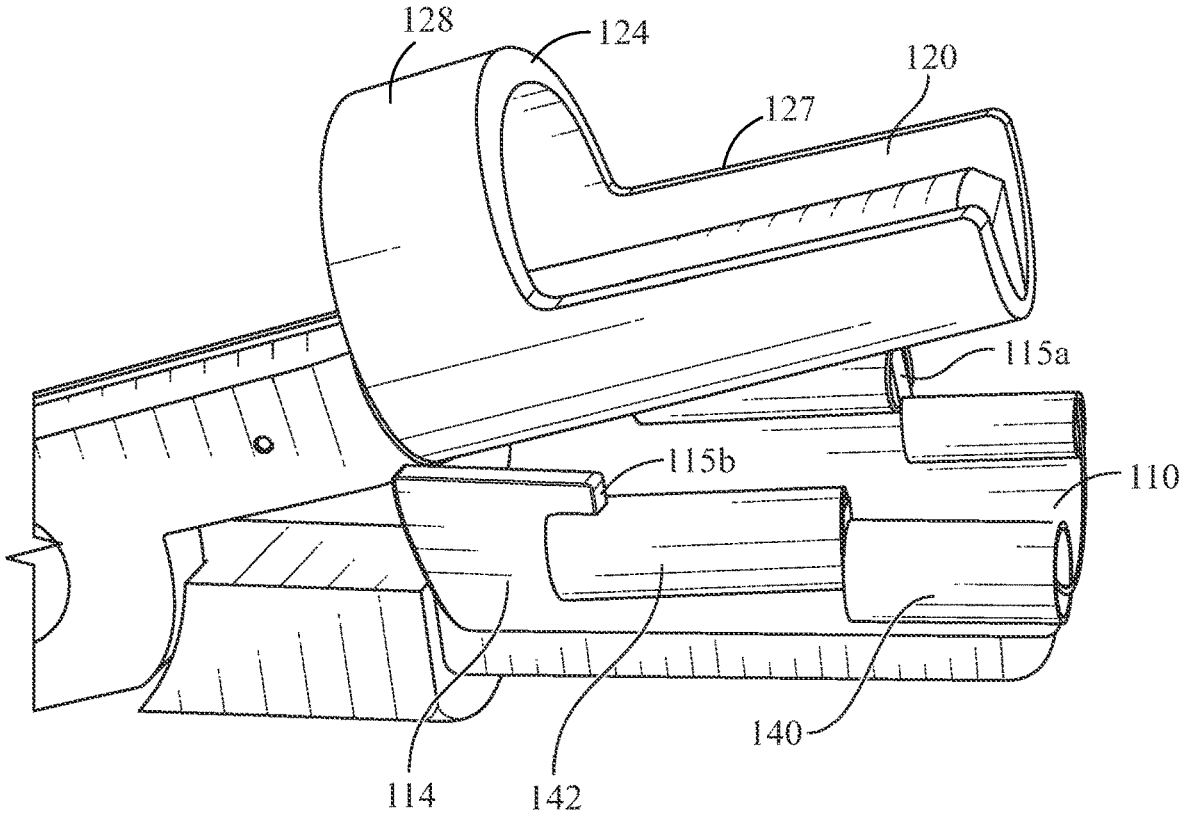
FIG. 8 shows an oblique side view of a wire shaping tool, according to embodiments described herein.
Figure 9A:
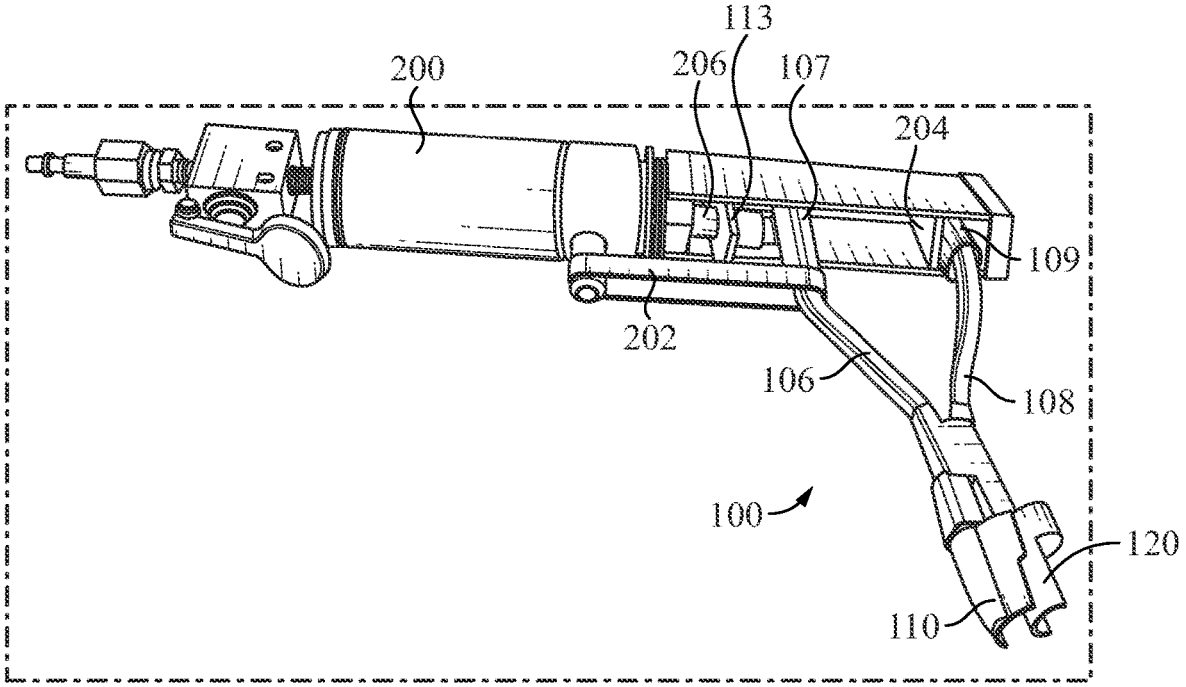
FIG. 9A shows an oblique side view of the wire shaping tool in FIG. 2 as implemented in a pneumatic actuator, according to embodiments described herein.
Figure 9B:
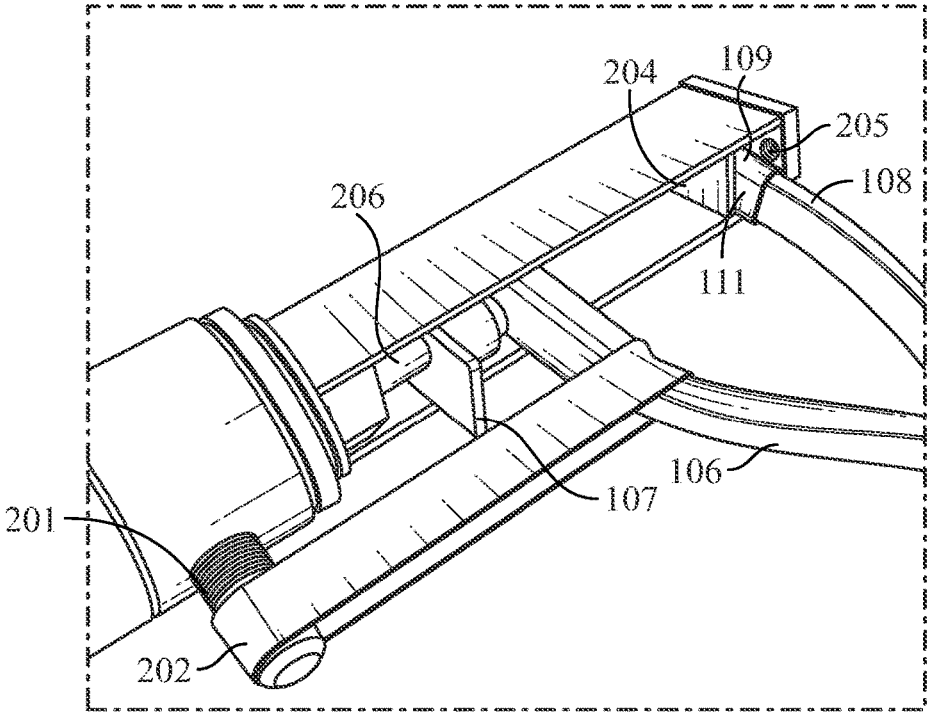
FIG. 9B shows a zoomed-in view of the wire shaping tool in FIG. 9A, according to embodiments described herein.

In some embodiments, the elongate body of the first jaw 110 comprises a plurality of steps that demarcate discrete portions of the elongate body. In such embodiments, each of the portions is defined by the sections of lateral edges created by the steps. For example, the first section of lateral edges is separated from the second section of lateral edges by a first step, and the second section of lateral edges is separated from the third section of lateral edges by a second step. The different sections of the lateral edges are non-planar to one another. In some embodiments, the first jaw 110 comprises one step, two steps, three steps, etc., and those steps demarcate a first section of lateral edge, a second section of lateral edge, a third section of lateral edge, etc. As shown in FIGS. 7 and 8, for example, the first jaw 110 comprises three sections of non-planar lateral edges on each side of the elongate body of the jaw, and two steps 115*a*, 115*b* are positioned between the three sections of non-planar lateral edges. In such embodiments, the first section of lateral edges is positioned in front of the first step 115*a* and the second section of lateral edges is positioned in front of the second step 115*b*.

In embodiments with a plurality of steps and discrete portions of the elongate body, the first jaw 110 comprises a plurality of caps to cover the lateral edges of each discrete portion, or a lesser included number of caps. In FIGS. 7 and 8, for example, the first and second portions of lateral edges are covered by caps 140, 142, respectively. The multiple lateral edge sections on the first jaw 110 in this embodiment provide the user with an option of staged wire compression, which involves reshaping an object such as a wire first in the outermost section, where the height (between the lateral edges and the surface 125) is relatively lowest and then reshaping the object again in the next stage, where the height is relatively greater. In such embodiments, the different sections allow for deeper bending of the object in the jaw as the object is inserted into a section closer to the fulcrum. When the object to be reshaped is a coated wire mesh, the staged reshaping can be advantageous because the wire coating tends to crack if too much compressive force is applied at once, whereas a series of staged compressions involving increasing step heights and increasing compressive force allows the coating to stretch elastically instead of cracking.

In various embodiments, the caps 140, 142 improve the function of the tool 100 by increasing the surface area that engages the wire mesh panel, and therefore disperse the compressive force produced by actuating the wire shaping tool 100 over a larger area. In some embodiments, the caps 140, 142 improve the method of reshaping wire mesh using the wire shaping tool 100 because the caps 140, 142 reduce the stress and damage absorbed by the wire during use. For example, as shown in FIG. 12, the caps 140 are positioned under the vertices formed at the intersection of shute wire S1 and warp wires W2 and W3.

Figure 10A:
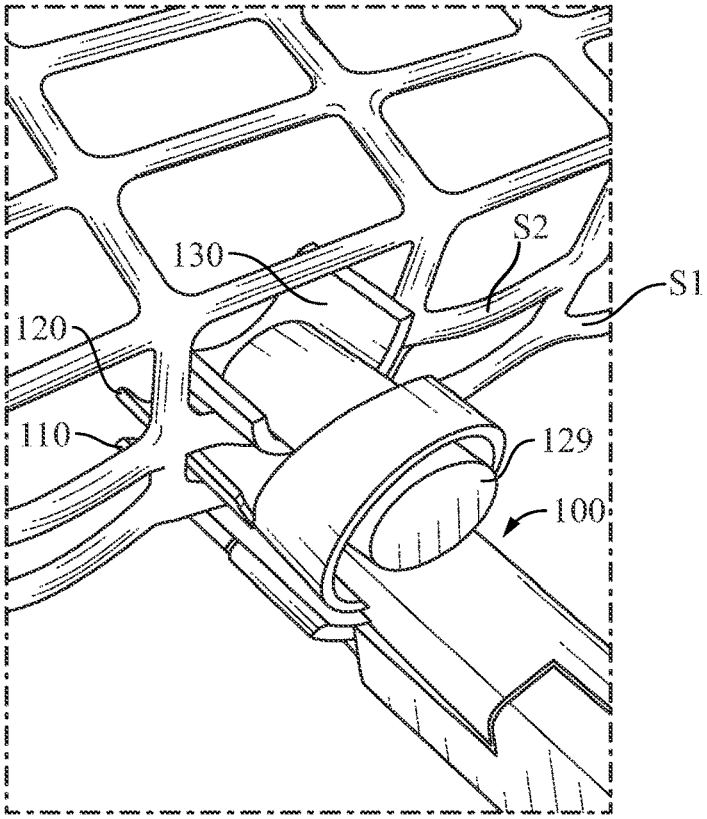
FIG. 10A illustrates the use of the wire shaping tool in FIG. 5 from an oblique rear perspective view, according to embodiments described herein.
Figure 10B:
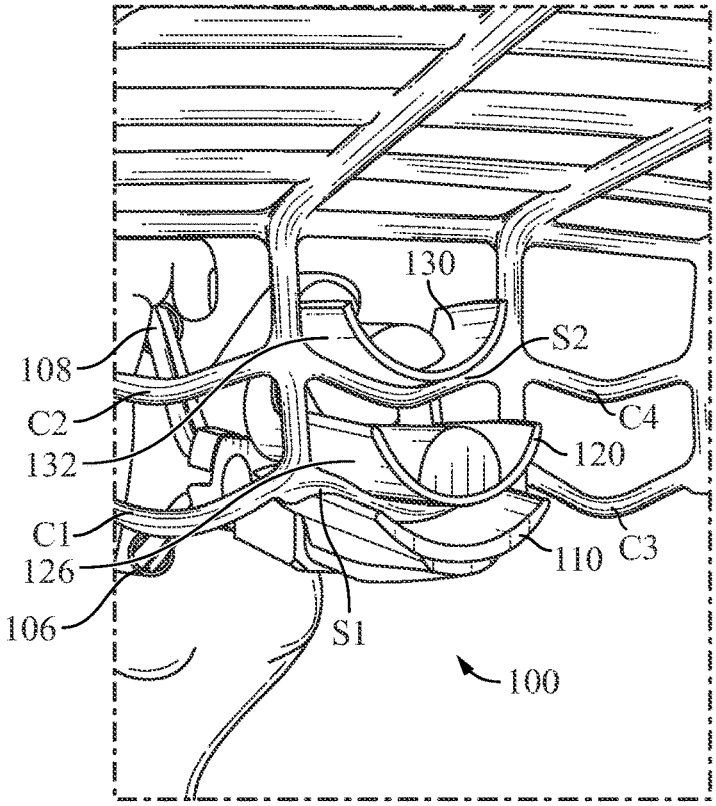
FIG. 10B illustrates the use of the wire shaping tool in FIG. 10A from an oblique front perspective view, according to embodiments described herein.
Figure 11:
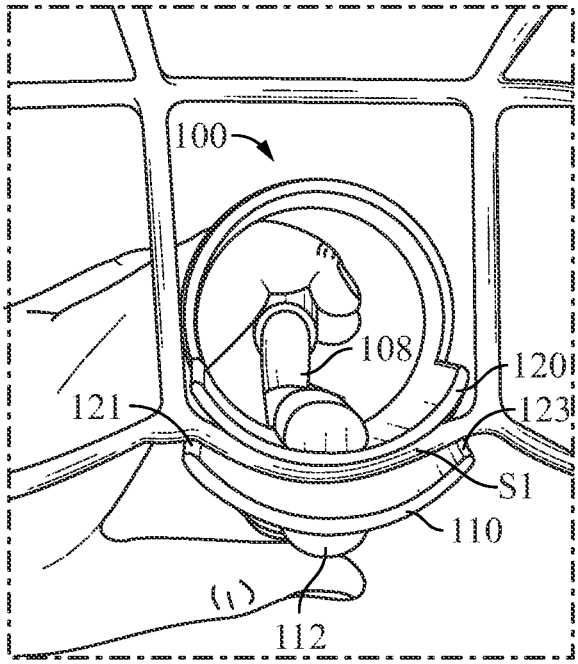
FIG. 11 illustrates the use of the wire shaping tool in FIG. 4A from a front perspective view, according to embodiments described herein.

In some embodiments, the second jaw 120 comprises a shape that is complementary to the shape of the first jaw 110. In such embodiments, during the step of actuating the tool 100 from an open position (as shown in FIG. 2 with a spaced distance between the surface 125 of the first jaw 110 and the surface 126 of the second jaw 120) toward a closed position (as shown in FIGS. 10B, 11, and 12), the first and second jaws 110, 120 are configured to converge toward one another (and, in some instances, the first and second jaws contact one another) or until the pair of jaws contact an object positioned therebetween. In some embodiments, for example, the first jaw 110 comprises a semicylindrical elongate body with a concave surface 125 and the second jaw 120 comprises a complementary elongate body with a convex surface 126 that is configured to accommodate the concave surface 125.

Alternative shapes for the first and second jaws 110, 120 are contemplated. In some embodiments, for example, the semicylindrical shape of the first jaw 110 is modified to be tapered toward the fulcrum. In some embodiments, the modified semicylindrical shape of the first jaw 110 is tapered toward the open end of the jaw. In such embodiments, the tapered shape means the lateral edges 121, 123 will be closer to one another at one end and farther from each other at the opposing end. In such embodiments, the variable distance between lateral edges allows for a variable amount of available surface 125 on the first jaw 110 for the object inserted into the jaws to contact upon actuation of the jaws. In such embodiments, the second jaw 120 comprises a shape that is complementary to the shape of the first jaw 110. In some embodiments, the first jaw 110 comprises two or more semicylindrical shaped jaw sections, each section having lateral edges independent from those of other sections while sharing the same surface 125. In such embodiments, the second jaw 120 comprises a shape that is complementary to the shape of the first jaw 110.

In some embodiments, the second jaw 120 comprises a hemicylindrical, semicylindrical, or cylindrical shape, in whole or in part, as shown in FIGS. 2-9A and 10A-14. During use, when the jaws 110, 120 are in the closed position or when they are approaching (i.e., converging toward) the closed position, a suitable object such as a wire can be pressed therebetween and forced to adopt the shape corresponding to the upper surface 125 of the first jaw 110 and the lower surface 126 of the second jaw 120.

In some embodiments, the size of the second jaw 120 is complementary to the size of the first jaw 110. In such embodiments, because activation of the tool 100 to the closed position causes the first and second jaws 110, 120 to converge toward contact with one another, the size of the second jaw 120 is not larger than the size of the first jaw 110. In some embodiments, the size of the second jaw 120 is equal to or smaller than the size of the first jaw 110. In this context, the size of the jaws relates to the ability of the second jaw 120 to fit, at least in part, within the structure of the first jaw 110. For example, when the first and second jaws 110, 120 are semicylindrical, the diameter of the second jaw 120 may be equal to or less than the diameter of the first jaw 110, which allows the surface 126 to come into contact with the upper surface 125 or an object positioned between the jaws.

In some embodiments, the second jaw 120 comprises a step 124, as shown in FIGS. 2-6B, 8, 9A, 10A-14. In such embodiments, the step 124 demarcates a front portion 127 of the second jaw 120 from the rear portion 128 of the second jaw 120. In such embodiments, the front and rear portions 127, 128 of the second jaw 120 have different heights when defined in the same manner as the heights of the front and rear portions 116, 114 of the first jaw 110, respectively. In some embodiments, due to their difference in heights, the front portion 127 may be insertable through an aperture A of a wire mesh panel, whereas the rear portion 128 may not be insertable through the aperture A depending on the relative size of the aperture A. For the embodiments in which the rear portion 128 cannot be inserted through the aperture A, the rear portion 128 functions as a stop that prevents the wire from being inserted further toward the fulcrum of the tool 100.

In some embodiments, the second jaw 120 comprises a third shaping component that allows the tool 100 to reshape two objects (e.g., wire) simultaneously. For example, as shown in FIGS. 5-6B, 10A, and 10B, the tool 100 comprises the third shaping component 130. In such embodiments, the third shaping component 130 comprises a coupling arm 129 for attaching the component 130 to the second jaw 120, as shown in FIGS. 5 and 10A. In some embodiments, the third shaping component 130 comprises a surface 132 that is used to reshape a wire inserted in the spaced distance between the second jaw 120 (or the second post 122, if present) and the third shaping component 130. In some embodiments, a first wire is positioned in the spaced distance between the first and second jaws 110, 120 and a second wire is positioned in the spaced distance between the second jaw 120 and the third shaping component 130.

Figure 15B:
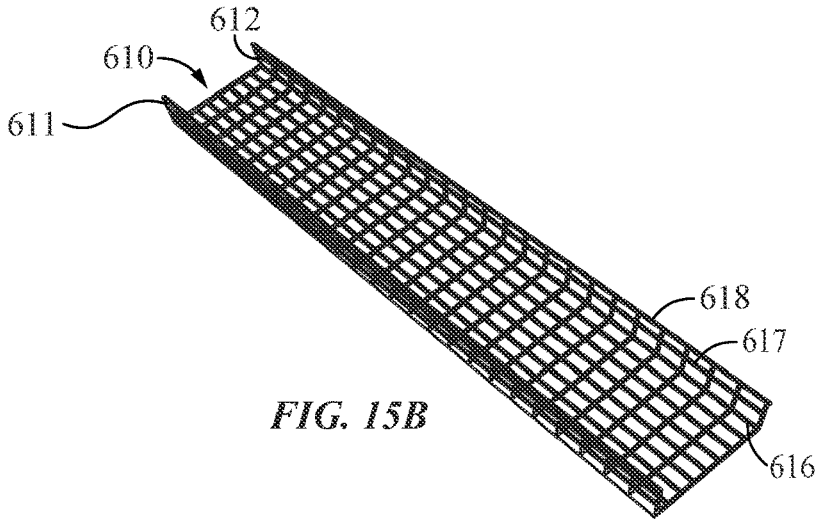
FIG. 15B shows the wire mesh panel of FIG. 15A after a bending step involved in the use of the wire mesh panel to create a structured item, according to embodiments described herein.

FIG. 10A shows the tool 100 interacting with a wire mesh panel having its two peripheral shute wires S1, S2 bent downward (see FIG. 15B). FIG. 10B shows the tool 100 in FIG. 10A from a different vantage point. In FIG. 10B, the tool 100 is external to the wire mesh and the view is from under the wire mesh panel looking outward. As shown in FIG. 10A and FIG. 10B, when the tool 100 is actuated by a user, a section of the first wire S1 will be reshaped as the second jaw 120 approaches the closed position, and a section of the second wire S2 will be reshaped as the third shaping component 130 is forced to move by the movement of the second jaw 120. In such embodiments, the forced movement of the third shaping component 130 causes the section of the second wire to adopt a shape corresponding to the surface 132. In such embodiments, the sections of the first and second shute wires S1, S2 are simultaneously reshaped from a substantially linear wire section to a curved wire section (e.g., C1, C2, C3, C4).

In some embodiments, the second jaw 120 comprises the step 124 to function as a backstop ("stop") that limits how far an object can be inserted into the spaced distance between the second jaw 120 and the third shaping component 130 during use. In some embodiments, the second jaw 120 further comprises, on a side opposite the surface 126, a support 122, as shown in FIG. 5. In some embodiments, the support 122 is absent and the second jaw 120 is configured as an integral component of a second lever of the tool 100.

In some embodiments, the tool 100 can be adapted for use in a mechanical device. As shown in FIGS. 6A, 6B, 9A, and 9B, for example, the first sleeve 109 is coupled to the first handle 108 and the second sleeve 107 is coupled to the second handle 106. In some embodiments, the first and second sleeves 109, 107 are configured to be removably coupled to the first and second handles 108, 106, respectively. In some embodiments, the first sleeve 109 includes a substantially flat surface 111 that is configured to engage a corresponding surface of the mechanical device, such as the pneumatic actuator 200. In some embodiments, the second sleeve 107 includes the foot 113 configured to releasably engage a corresponding surface of the mechanical device 200. In some embodiments, the first sleeve 109 directly engages a static component 204 of the device 200 and the foot 113 engages a dynamic component 206 of the actuator 200.

During use of the tool 100, in some embodiments, the pneumatic device 200 applies the force required to move the handles 106, 108 from an open position, in which the handles are more spaced apart, toward a closed position, in which the handles are less spaced apart, respectively, which in turn causes the jaws 110, 120 to move from the open position to the closed position. In such embodiments, the pneumatic device 200 applies the force required to move the dynamic component 206 toward the static component 204, which is comparable to squeezing the handles 106, 108 together by hand. After applying the force, the dynamic component 206 (e.g., a piston or moveable pin) retreats to its starting position so the process can be repeated. In some embodiments, an elastic member 202 is coupled to the actuator via component 201 to assist the dynamic component 206 in returning to its starting position. In some embodiments, the pneumatic device 200 is used to carry out the function typically performed by a user's hand. In some embodiments, an alternative mechanical device capable of the same function can be used instead of the pneumatic device 200.

FIGS. 10A-15C illustrate a method of using the tool 100 to reshape wire sections in a wire mesh panel. As shown in FIG. 15A, the method comprises providing a flat or substantially flat wire mesh panel 600 comprising a plurality of shute wires (e.g., 602) extending the length of the panel and a plurality of transverse warp wires (e.g., 604) extending the width of the panel. In this context, the term "substantially flat" refers to when a wire mesh panel is obtained from a roll of wire mesh. Specifically, when wire mesh is rolled up in a roll for storage and transport and then unrolled to obtain a wire mesh panel, the unrolled wire mesh panel may retain some amount of curvature due to its storage in the roll. In some embodiments, the method comprises converting the flat panel 600 into an intermediate, U-shaped cross-sectional structure 610 having a first lip 611 extending along a first longitudinal side of the flat panel 600, and a second lip 612 extending along the opposite longitudinal side, as shown in FIG. 15B. In such embodiments, the lips 611 and 612 are not co-planar with the unmodified section of wire mesh positioned therebetween. In such embodiments, the bending step can be carried out with a bending brake or another suitable tool for reshaping wire mesh or other metal panels (e.g., sheet metal).

In some embodiments, the intermediate panel structure 610 is formed by bending each of the warp wires along a longitudinal axis defined by a shute wire, such as shute wire 616, to form a lip (612 in this example). In FIG. 15B, the shute wire 616 is two apertures from the edge of the wire mesh panel, the shute wire 617 is one aperture from the edge of the wire mesh panel, and the shute wire 618 defines the edge of the wire mesh panel. In some embodiments, the step of bending the warp wires about a longitudinal axis defined by a shute wire is repeated for the opposite longitudinal side of the wire mesh panel 600 to obtain the lip 611 and, ultimately, to arrive at the intermediate U-shaped cross-sectional panel structure 610.

Figure 15C:
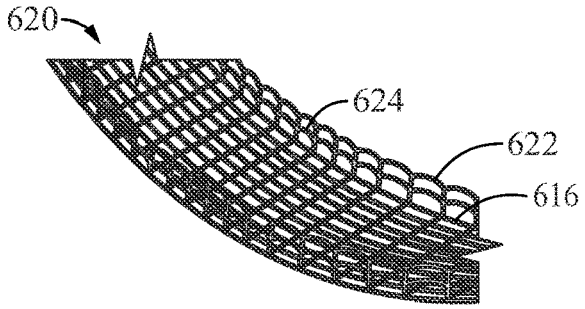
FIG. 15C shows the wire mesh panel of FIG. 15B after a reshaping step involved in the use of the wire mesh panel to create a structured item, according to embodiments described herein.

In some embodiments, the method further comprises converting the intermediate structure 610 into a predetermined target structure. For example, as shown in FIG. 15C, the target structure 620 comprises the lips 611, 612, and each lip comprises two rows of shute wire (622, 624), each having modified wire sections between two sequential warp wires. The shape of the wire sections in the shute wire 616, which was used as a fulcrum to create the lips 611 and 612, have not been modified.

Figure 13:
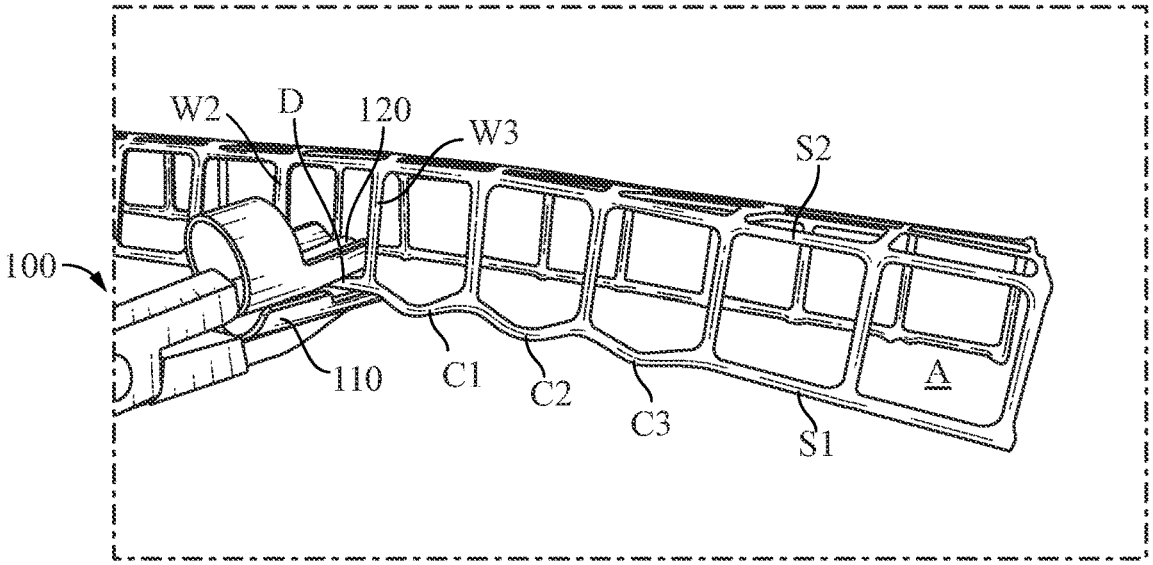
FIG. 13 illustrates the use of the wire shaping tool in FIG. 2 from a rear perspective view, according to embodiments described herein.
Figure 14:
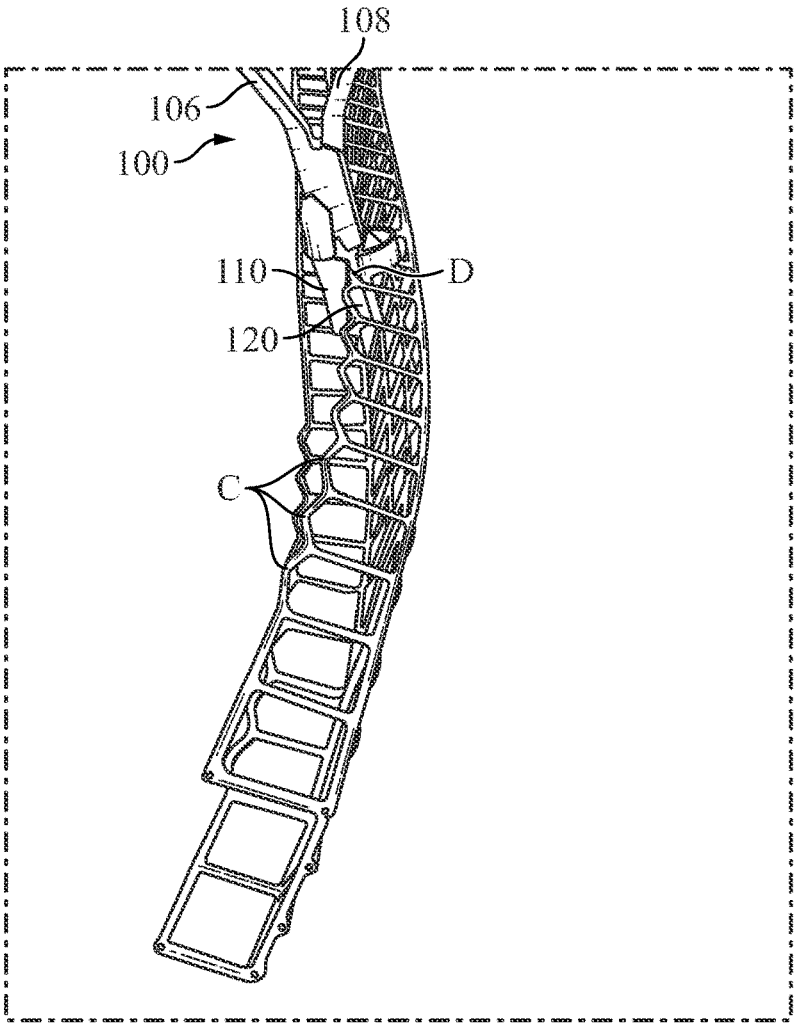
FIG. 14 illustrates the use of the wire shaping tool in FIG. 2 from a side perspective view, according to embodiments described herein.

In various embodiments, the method of modifying the wire sections between each of the warp wires in the lips 611, 612 comprises the use of the wire shaping tool 100. As shown in FIGS. 13 and 14, the section D of shute wire S1 is inserted between the first and second jaws 110, 120 of the tool 100. In such embodiments, the handles 106, 108 are compressed, which due to the fulcrum causes the first and second jaws 110, 120 to also be compressed. As the section D of shute wire S1 is contacted by the first and second jaws 110, 120 during the compression, the compression force transforms the wire section D from a linear shape to a curved shape. The curved wire sections of shute wire S1 are labeled C in FIGS. 10B-14.

In some embodiments, the method comprises reshaping a wire section D of a single wire (e.g., S1), as shown in FIGS. 11-14. In some embodiments, the method comprises reshaping a wire section D of a plurality of wires (e.g., S1, S2, etc.), as shown in FIGS. 10A, 10B, and 15C. For example, in FIGS. 10A and 10B, the tool 100 was used to transform the linear shape of the wire sections in S1 and S2 into curved wire sections C.

In some embodiments, the method causes the structure 620 to adopt an arched three-dimensional shape. During the modification process, as the shute wires on opposing lips of the intermediate structure 610 are modified, the overall shape of the structure takes on an arched, semicircular, curved shape, as shown in FIGS. 14 and 15C. Surprisingly, the three-dimensional shape of the arched wire mesh structure 620 forms naturally because of the linear wire sections in shute wires 617 and 618 being converted into curved wire sections of the shute wires 624 and 622, respectively. In some embodiments, after each wire section D of the shute wires 617 and 618 has been converted into the curved wire sections C of the shute wires 624 and 622, the obtained arched structure 620 can then be used in the construction of a three-dimensional item. For example, the object in FIG. 16 comprises exterior boundary panels with wires 710, 712 (shute wires of the front and rear lips, respectively) that were prepared using the method.

Figure 16:
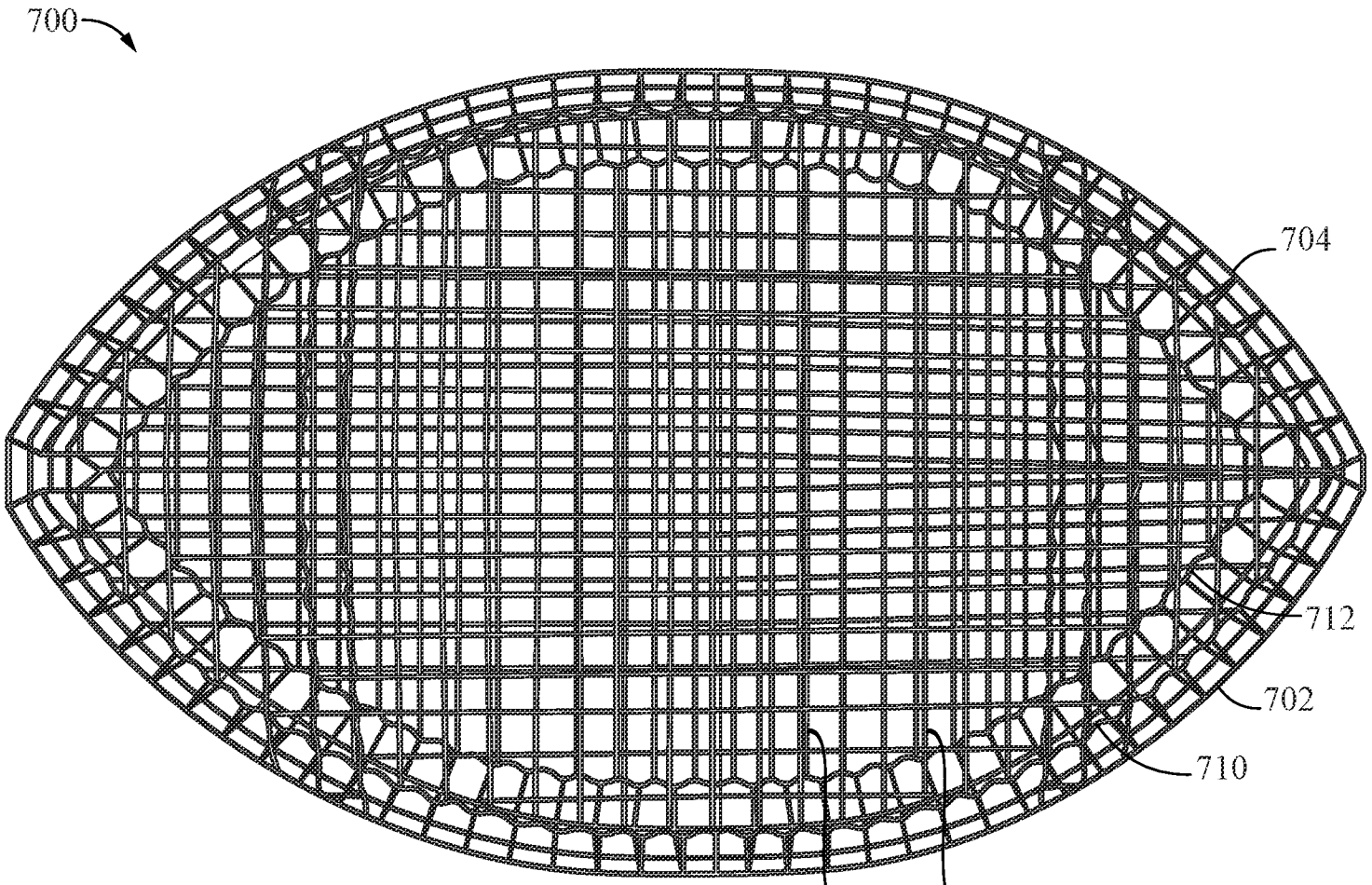
FIG. 16 shows a shaped item created using a wire shaping tool and method according to embodiments described herein.

FIG. 16 shows an example of a three-dimensional item 700 that was formed using the wire shaping tool 100. The football-shaped item 700 comprises a substantially flat front panel 706 and a substantially flat rear panel 708. The front and rear panels 706, 708 are positioned a spaced distance from one another, and the spaced distance is defined by the width of the upper and lower exterior boundary panels 702, 704 (the spaced distance lies in the plane coming out of the page), which are connected to the perimeter of each of the front and rear panels. In some embodiments, the spaced distance between the front and rear panels is the same throughout the structure of the item 700. In some embodiments, the spaced distance between the front and rear panels is non-uniform (i.e., portions of the front panel may be further separated from the rear panel than other portions). During the assembly process of the football-shaped item 700, the upper and lower exterior boundary panels 702, 704 were prepared according to the method described above and illustrated in FIGS. 13 and 14, in which the arched three-dimensional shape of each of the boundary structures was formed as a natural result of reshaping the linear wire sections in the shute wires into the curved wire sections 710, 712 with the wire shaping tool 100.

Figure 17:
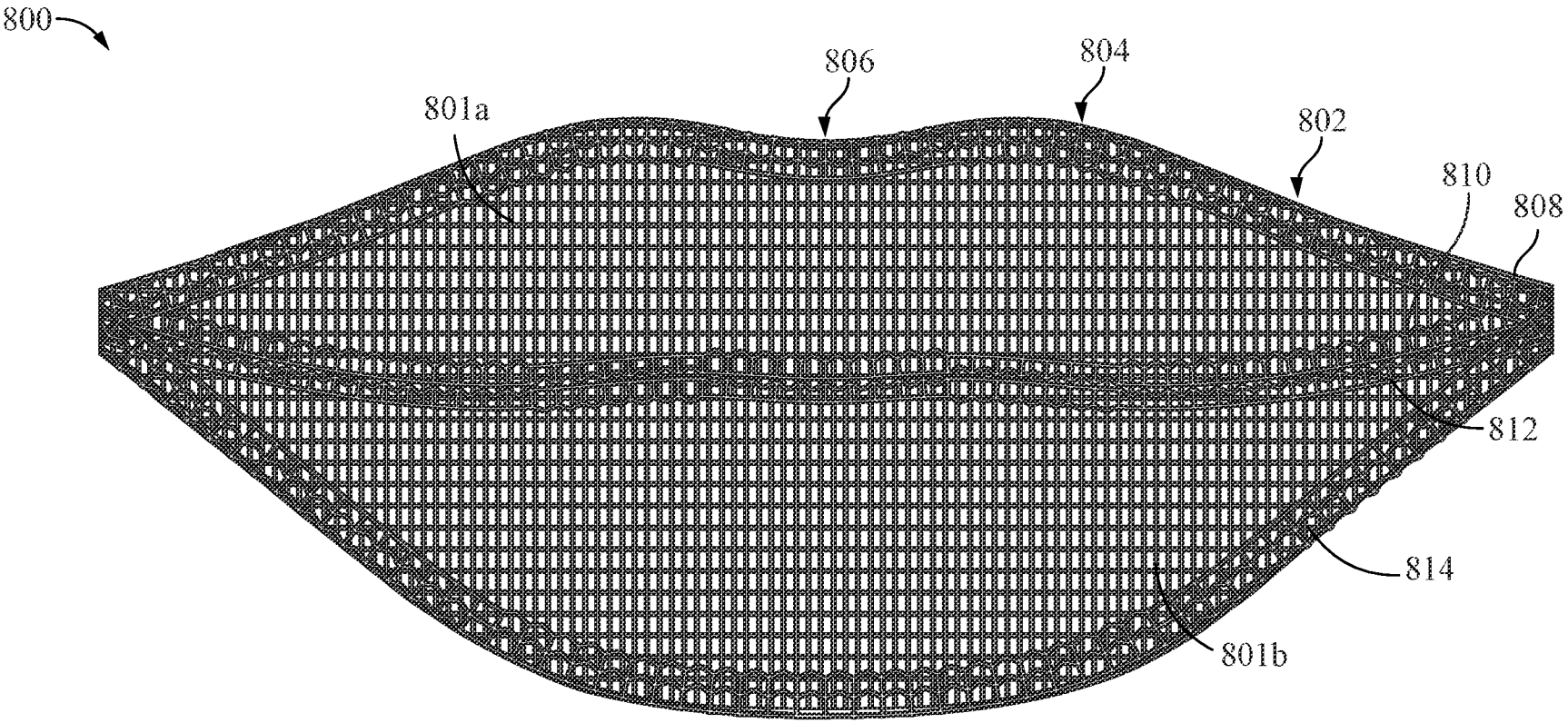
FIG. 17 shows a shaped item created using a wire shaping tool and method according to embodiments described herein.

FIG. 17 shows another example of a three-dimensional item 800 that was constructed using the wire shaping tool 100. The lips-shaped item 800 comprises a substantially flat front panel 801*a*, 801*b* on the top and bottom lips, respectively; an exterior boundary panel 808, 814 on the top and bottom lips, respectively; and an interior boundary panel 810, 812 on the top and bottom lips, respectively. The lips-shaped item 800 further comprises a substantially flat rear panel that has been omitted for clarity; the rear panel having two components arranged in the manner shown for the front panel 801*a*, 801*b*. Also omitted for clarity is the rear side lip of the interior and exterior boundary panels 808, 810, 812, 814; components that are arranged in the manner shown for the front side. The front and rear panels are positioned a spaced distance from one another, and the spaced distance is defined by the width of the exterior boundaries 808, 814 and interior boundaries 810, 812 (the spaced distance lies in the plane coming out of the page). In some embodiments, a first spaced distance defined by the width of the of the exterior boundaries 808, 814 and a second spaced distance defined by the interior boundaries 810, 812 are the same. In some embodiments, the first and second spaced distances are not the same (e.g., the second spaced distance defined by the interior boundaries 810, 812 can be wider).

During the assembly process of the lips-shaped item 800, the interior and exterior boundary panels 808, 810, 812, 814 for the top and bottom lips were prepared according to the process described in FIGS. 15A-15C. In the process, the three-dimensional arch shape of each of the boundary panels was formed as a natural result of reshaping the wire sections D in one or two shute wires into curved wire C sections using the tool 100. The lips-shaped item 800 in FIG. 15 features concave and convex shapes along the interior and exterior boundary panels. Regarding the exterior boundary panel 808, the outer portion 802 is slightly convex, the intermediate portion 804 is concave, and the center portion 806 is convex. In this example, the edge shute wire in the outer and center portions 802, 806 was not modified, whereas the edge shute wire in intermediate portion 804 was modified into a curved wire sections C. During the assembly process, the front panel 801*a*, 801*b* can be attached to the interior and exterior boundary panels 808, 810, 812, 814 at the edge shute wire (618 in FIG. 15C) or at a non-edge shute wire (617 or 616 in FIG. 15C). In the embodiment shown in FIG. 17, the front panel 801*a*, 801*b* is attached to a non-edge shute wire on the interior and exterior boundary panels. In other embodiments, the front panel 801*a*, 801*b* is attached to the edge shute wire on the interior and exterior boundary panels. The example in FIG. 17 illustrates the artistic flexibility that the wire shaping tool 100 offers. In some embodiments, the tool 100 can be used to manipulate the shape of a wire panel in an upward or downward direction or in a concave or convex direction (depending on the viewer's perspective).

Figure 18:
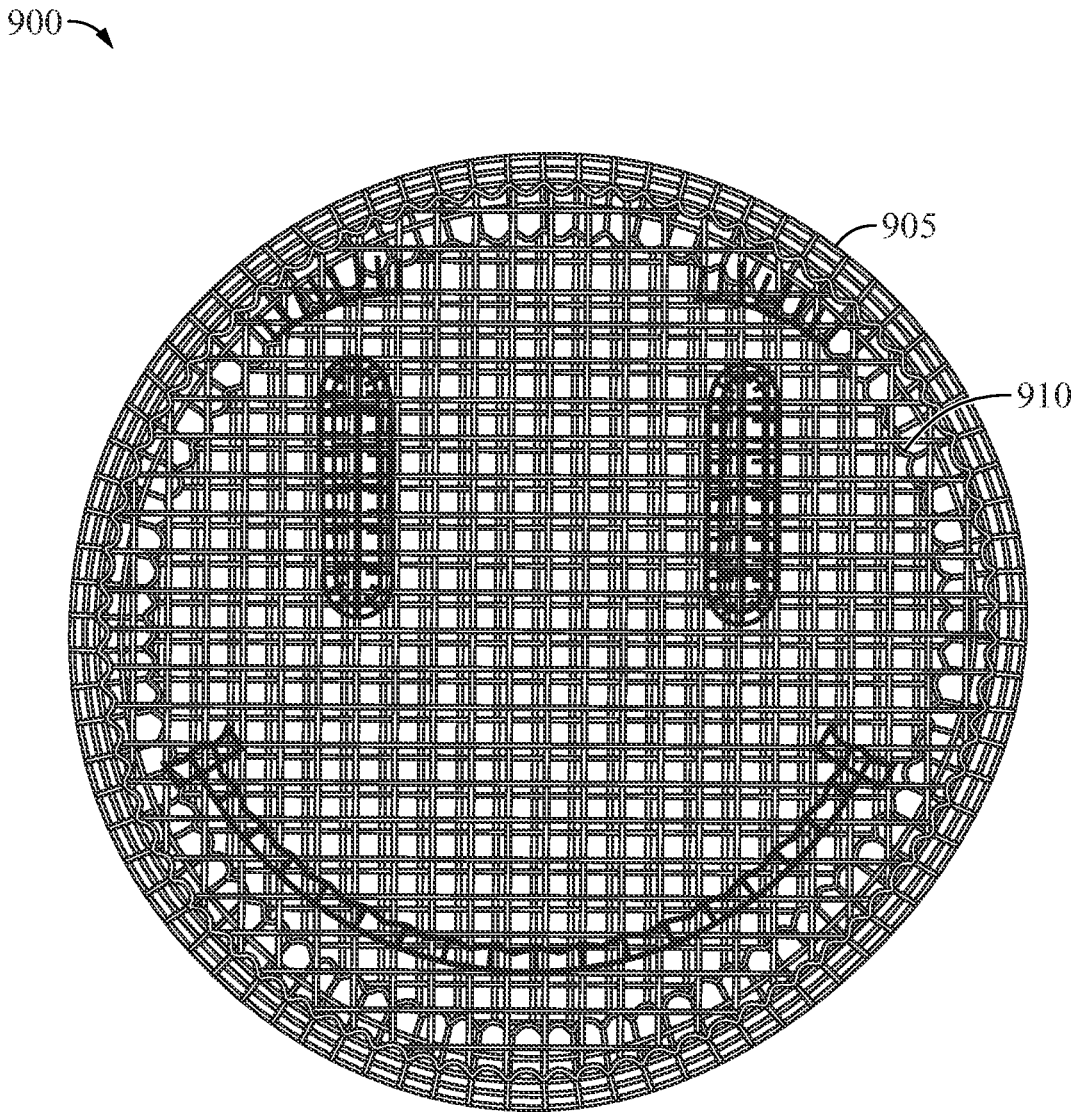
FIG. 18 shows a shaped item created using a wire shaping tool and method according to embodiments described herein.

FIG. 18 shows another example of a three-dimensional item 900 that was created using the wire shaping tool 100. The puck-shaped item 900 comprises a substantially flat rear panel and a substantially flat front panel (shown in the plane of the page), whereby the front and rear panels are positioned a spaced distance from one another, and the spaced distance is defined by the width of the one or more exterior boundary panel(s) 905 (the spaced distance lies in the plane coming out of the page), which is connected to the perimeter of the front and rear panels. During the assembly process of the puck-shaped item 900, the one or more exterior boundary panel(s) 905 was constructed according to the method described in FIGS. 15A-15C, in which the three-dimensional arched shape of the one or more exterior boundary panel(s) 905 was formed as a natural result of reshaping the linear wire sections D of an edge warp wire into curved wire sections C, such as shute wire 910.

In various embodiments, a wire shaping tool 100 and method of using the tool to create various three-dimensional items are provided. The tool 100 is configured to transform the shape of a linear wire (e.g., an individual wire section in a wire mesh) into a non-linear wire. The features of the tool, including the complementary surfaces 116 and 126 on the first and second jaws, respectively, are configured to transform the shape of one or more sections and/or pieces of linear wire into curved wire sections such that a substantially flat, two-dimensional object is transformed into a shaped three-dimensional item. In some embodiments, the tool 100 further includes the third shaping component 130 having a surface 132 that can be utilized to simultaneously transform the wire sections D of two parallel wires, such as parallel, adjacent wires in a wire mesh panel. In some embodiments, the tool 100 is adapted for a mechanical device, in which the handles 106, 108 are coupled to sleeves 107, 109, respectively. In some embodiments, one of the sleeves (e.g., sleeve 107) further comprises a foot 113 that is adapted to engage moving parts of the mechanical device.

In some embodiments, the method of using the tool 100 to transform the shape of linear wire sections of a wire mesh (e.g., FIG. 15A) into non-linear wire sections for the purpose of creating a three-dimensional shaped item is provided. The method includes a step of bending at least one row of longitudinal wires on the wire mesh from a substantially planar position to a non-planar, or transverse, position (e.g., FIG. 15B). In some embodiments, the bending step repositions longitudinal wire to a perpendicular or substantially perpendicular position. In some embodiments, two or more rows of longitudinal wire, or three or more rows of longitudinal wire, are realigned in the bending step. In some embodiments, the method further includes a step of transforming the shape of one or more specific sections of the bent row(s) of longitudinal wire from a linear wire to a curved wire (e.g., FIG. 15C) to obtain a reshaped wire mesh panel. In some embodiments, the method further includes integrating the reshaped wire mesh panel (e.g., 620 in FIG. 15C), which has at least one row of bent wire and one or more specific sections of curved wire, into the overall structure of the three-dimensional item being prepared. In the integration step, the reshaped wire mesh panel can be combined with flat panels, such as the front panels shown in FIGS. 16-18, substantially flat panels, or other suitable non-flat panels, such as panels featuring a rounded, peaked, curved, angled, or other suitable shape. In some embodiments, the reshaped wire mesh panel and/or one or more other shaped panels of wire mesh can be coupled and secured together with a suitable fastener (e.g., wires, hog rings, zip ties, string, fishing line, etc.).

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

I claim:

1. A wire shaping tool, comprising:

a pair of levers joined at a fulcrum positioned closer to one end of the levers, the pair of levers comprising a pair of jaws on a first side of the fulcrum and a pair of handles on a second side of the fulcrum, wherein the second side has a second length that is longer than a first length of the first side, wherein the pair of jaws and the pair of handles are oriented about a longitudinal axis defined by the wire shaping tool, and wherein the pair of jaws are movable about the fulcrum between an open position defined by a spaced distance between the first and second jaws, and a closed position defined by a converging of the first and second jaws;

wherein the pair of jaws comprises a first jaw and a second jaw; the first jaw comprising an elongate body comprising a concave surface having a pair of opposing lateral edges, the elongate body comprising a front portion demarcated from a rear portion by a step on each of the opposing lateral edges; and the second jaw comprising a complementary convex surface configured to contact the concave surface of the first jaw;

wherein the elongate body of the first jaw is oriented about the longitudinal axis; and wherein the concave and complementary convex surfaces are configured to transform a first shape of a first object positioned in the spaced distance into a second shape as the pair of jaws is actuated to approach the closed position with the object therebetween.

2. The wire shaping tool of claim 1, further comprising a pair of caps covering the opposing lateral edges of the front portion of the first jaw.

3. The wire shaping tool of claim 1, wherein the front and rear portions of the elongate body of the first jaw have different heights, the different heights being demarcated by the step on each of the opposing lateral edges.

4. The wire shaping tool of claim 1, wherein the front portion of the elongate body of the first jaw is insertable through an aperture of a wire mesh panel, and the rear portion is not insertable through the aperture due to the step on each of the opposing lateral edges of the elongate body.

5. The wire shaping tool of claim 1, wherein the second jaw comprises an elongate body comprising a front semi-cylindrical shaped portion demarcated from a rear cylindrical portion.

6. The wire shaping tool of claim 5, further comprising a third shaping component projecting from the rear cylindrical portion of the second jaw, the third shaping component comprising a convex surface for reshaping a second object positioned in a second spaced distance between the second jaw and the third shaping component, wherein the convex surface of the third shaping component faces the second jaw.

7. The wire shaping tool of claim 6, wherein the second jaw is insertable through a first aperture of the wire mesh, and the third shaping component is insertable through a second aperture of the wire mesh, wherein the first and second apertures are adjacent to one another.

8. The wire shaping tool of claim 7, wherein the front semi-cylindrical shaped portion of the second jaw is configured to reshape a first wire section of the wire mesh and the third shaping component is configured to reshape a second wire section of the wire mesh, wherein the first and second wire sections are parallel and sequentially adjacent to one another.

9. A wire shaping tool, comprising:

a pair of levers joined at a fulcrum positioned closer to one end of the levers, the pair of levers comprising a pair of jaws on a first side of the fulcrum and a pair of handles on a second side of the fulcrum, wherein the second side has a second length that is longer than a first length of the first side, and wherein the pair of jaws are movable about the fulcrum between an open position defined by a spaced distance between the first and second jaws, and a closed position defined by a converging of the first and second jaws;

wherein the pair of jaws comprises a first jaw and a second jaw; the first jaw comprising an elongate body comprising a concave surface having a pair of opposing lateral edges, the elongate body comprising a front portion demarcated from a rear portion by a step on each of the opposing lateral edges; and the second jaw comprising a complementary convex surface configured to contact the concave surface of the first jaw;

wherein the concave and complementary convex surfaces are configured to transform a first shape of a first object positioned in the spaced distance into a second shape as the pair of jaws is actuated to approach the closed position with the object therebetween; and wherein the second jaw further comprises a third shaping component projecting from a rear cylindrical portion of the second jaw, the third shaping component comprising a convex surface for reshaping a second object positioned between the second jaw and the third shaping component, wherein the convex surface of the third shaping component faces the second jaw.

10. The wire shaping tool of claim 9, further comprising a pair of caps covering the opposing lateral edges of the front portion of the first jaw.

11. The wire shaping tool of claim 9, wherein the front and rear portions of the elongate body of the first jaw have different heights, the different heights being demarcated by the step on each of the opposing lateral edges.

12. The wire shaping tool of claim 9, wherein the front portion of the elongate body of the first jaw is insertable through an aperture of a wire mesh panel, and the rear portion is not insertable through the aperture due to the step on each of the opposing lateral edges of the elongate body.

13. The wire shaping tool of claim 9, wherein the second jaw comprises an elongate body comprising a front semi-cylindrical shaped portion demarcated from the rear cylindrical portion.

14. The wire shaping tool of claim 9, wherein the second jaw is insertable through a first aperture of the wire mesh, and the third shaping component is insertable through a second aperture of the wire mesh, wherein the first and second apertures are adjacent to one another.

15. The wire shaping tool of claim 14, wherein the front semi-cylindrical shaped portion of the second jaw is configured to reshape a first wire section of the wire mesh and the third shaping component is configured to reshape a second wire section of the wire mesh, wherein the first and second wire sections are parallel and sequentially adjacent to one another.

16. A method of reshaping certain wire sections of a mesh wire panel, comprising:

providing the panel of wire mesh comprising a plurality of wires positioned parallel to one another about a longitudinal axis and a plurality of wires positioned parallel to one another about a transverse axis, the plurality of longitudinal and transverse wires being integrated into the panel of wire mesh to provide a plurality of apertures, each aperture defined by a pair of sequential, spaced apart longitudinal wires and a pair of sequential, spaced apart transverse wires;

providing a tool comprising a pair of levers joined at a fulcrum positioned closer to one end of the levers, the pair of levers comprising a pair of jaws on a first side of the fulcrum and a pair of handles on a second side of the fulcrum, wherein the second side has a second length that is longer than a first length of the first side, and wherein the pair of jaws are movable about the fulcrum between an open position defined by a spaced distance between the first and second jaws, and a closed position defined by a converging of the first and second jaws;

wherein the pair of jaws comprises a first jaw and a second jaw; the first jaw comprising an elongate body comprising a concave surface having a pair of opposing lateral edges, the elongate body comprising a front portion demarcated from a rear portion by a step on each of the opposing lateral edges; and the second jaw comprising a complementary convex surface configured to contact the concave surface of the first jaw; and wherein the concave and complementary convex surfaces are configured to transform a first shape of a first mesh wire panel component positioned in the spaced distance into a second shape as the pair of jaws is actuated to approach the closed position with the first mesh wire panel component therebetween;

inserting a section of a first longitudinal wire of the mesh wire panel having the first shape into the spaced distance between the first and second jaws;

actuating the pair of handles to move the pair of jaws from the open position toward the closed position until interrupted by contacting the section of the first longitudinal wire; and further actuating the pair of handles to transform the section of the first longitudinal wire into the second shape.

17. The method of claim 16, wherein the tool further comprises a pair of caps covering the opposing lateral edges of the front portion of the first jaw.

18. The method of claim 16, wherein the second jaw comprises an elongate body comprising a front semi-cylindrical shaped portion demarcated from a rear cylindrical portion.

19. The method of claim 18, wherein the second jaw further comprises a third shaping component projecting from the rear cylindrical portion of the second jaw, the third shaping component comprising a convex surface for reshaping a second mesh wire panel component positioned in a second spaced distance between the second jaw and the third shaping component, wherein the convex surface of the third shaping component faces the second jaw; and inserting a section of a second longitudinal wire of the mesh wire panel into the second spaced distance, wherein the actuating the pair of handles step causes the third shaping component to contact and reshape the section of the second longitudinal wire.

20. The method of claim 16, wherein the first shape is substantially linear and the second shape is curved.

* * * * *